US005524878A

United States Patent [19]

Trouquilla

[11] Patent Number: 5,524,878

[45] **Date of Patent: *Jun. 11, 1996**

[54] DAMPED PINCH-ROLL FOR DOCUMENT FEED

[75] Inventor: Michael N. Trouquilla, Livonia, Mich.

[73] Assignee: Unisys Corporation, Blue Bell, Pa.

[ * ] Notice: The term of this patent shall not extend beyond the expiration date of Pat. No. 5,303,913.

[21] Appl. No.: 549,886

[22] Filed: Oct. 30, 1995

Related U.S. Application Data

[63] Continuation of Ser. No. 225,108, Apr. 8, 1994, abandoned, which is a continuation of Ser. No. 76,292, Jan. 10, 1993, Pat. No. 5,303,913.

[51] Int. Cl.[6] ..... B65H 5/02

[52] U.S. Cl. ..... 271/274; 226/187

[58] Field of Search ..... 271/272, 273, 271/274; 226/181, 186, 187; 384/222

[56] References Cited

U.S. PATENT DOCUMENTS

| | | | |
|---|---|---|---|
| 3,353,879 | 11/1967 | Jorr | 384/222 |
| 3,756,589 | 9/1973 | Carbine | 271/274 |
| 4,775,142 | 10/1988 | Silverberg | 271/274 |
| 4,875,670 | 10/1989 | Petersen et al. | 271/273 |
| 4,997,179 | 3/1991 | Mizutani et al. | 271/274 |
| 5,303,913 | 4/1994 | Trouquilla | 271/274 |

FOREIGN PATENT DOCUMENTS

| | | | |
|---|---|---|---|
| 1263340 | 5/1961 | France | 271/274 |
| 0057452 | 3/1988 | Japan | 271/273 |

*Primary Examiner*—H. Grant Skaggs
*Attorney, Agent, or Firm*—John J. McCormack; Mark T. Starr

[57] ABSTRACT

A document feed array comprising a pinch-roll mounted to rotate about its center to engaged documents, being mounted on a cantilever-arm pivoted at a point distal from said roll-center and including an elastomeric sleeve which, alone, couples the arm to its pivot point (in operation), the sleeve comprising high-damping, durable elastomeric material adapted to accommodate thickness anomalies in said documents, yet to maximize driving contact therewith.

25 Claims, 3 Drawing Sheets

FIG. 1A
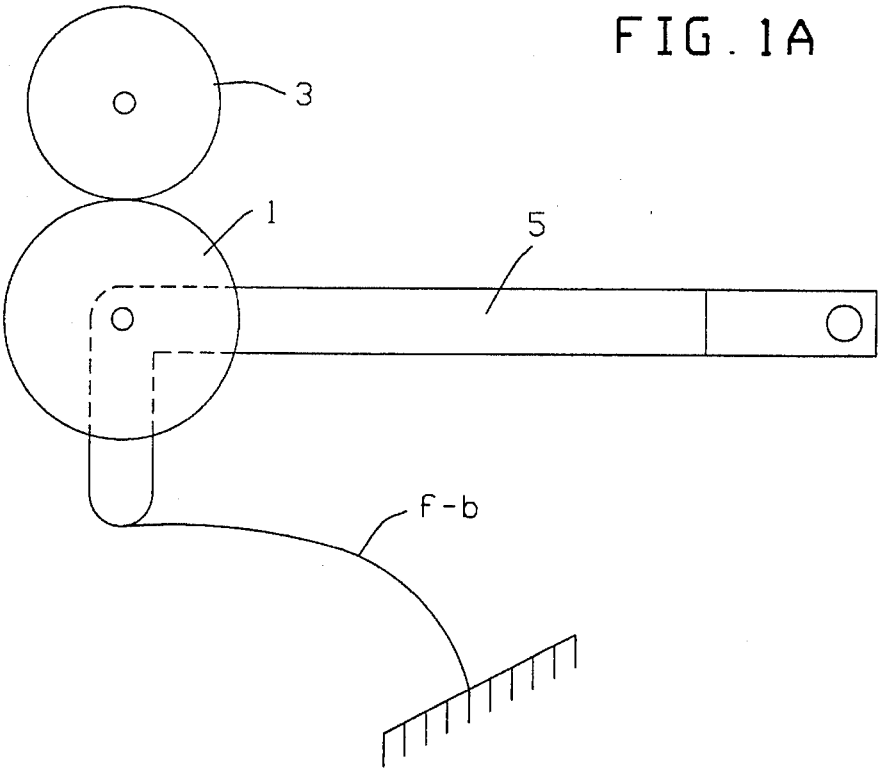
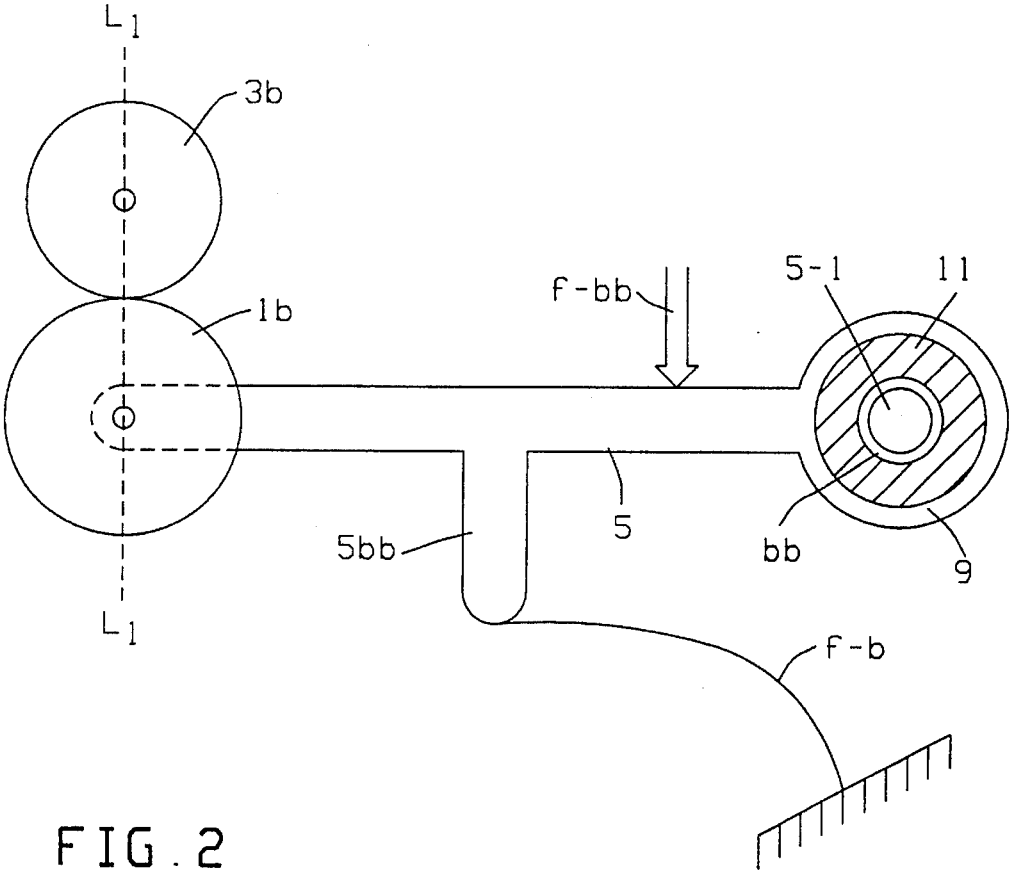
FIG. 2

DAMPED PINCH-ROLL FOR DOCUMENT FEED

This application is a continuation of patent application Ser. No. 08/225,108, filed 08 Apr. 1994 now abandoned which is a continuation of application Ser. No. 08/096,292 filed Jan. 10, 1993 and now U.S. Pat. No. 5,303,913.

This invention relates to document transport equipment, and especially to pinch rolls therefor.

BACKGROUND, FEATURES

Workers are aware that new and innovative high speed document transport systems are desirable. Workers are active in this field. Examples are described in U.S. Pat. Nos.: 5,029,845, 4,974,680, 5,098,082, 5,172,900, 4,903,954, 4,346,883, 4,425,694. Many such systems have typically employed opposed pinch-rolls and to accommodate variance in document thickness etc., have used resilient means therewith.

Previous resilient elements, such as air dashpots, bushings, sliding contact devices, and magnetic devices, require small gaps between components. These gaps collect paper dust which can interfere with normal functioning of the (movable) pinch roller. Other devices employ flexible damping material in the pinch roll (roller) itself. But this can cause overheating in the roller due to its constant rotation with a pinch load.

My invention avoids the foregoing problems, and involves means for damping a movable document transport pinch roller where the document transport must allow for gaps between documents, for documents of irregular thicknesses, and/or for unusual protrusions on the document such as staples and folds.

A salient object is to minimize transient motions of the movable pinch roll perpendicular to the document transport direction, so that the pinch rolls remain in intimate contact with the document at all times. Such transient motions occur where there are gaps between documents, irregular thicknesses, and/or protrusions such as staples or folds.

As a feature hereof, damping is provided through the use of a flexible damping material, such as poly-urethane, that also serves as a pivot bearing. A means of assembly prevents the damping material from experiencing a "static pro-load", and avoids related creep problems in the flexible damping material.

It is of particular interest to mount a movable pinch-roll or the like on an arm cantilevered-out from a pivot point defined by a fixed shaft, with this shaft surrounded by two concentric follow cylinders plus intermediate high-damping elastomeric material, as in FIG. 1.

Additionally, a resilient pre-load is preferably applied as in FIG. 1A (e.g. via a flexure).

Thus, it is an object hereof to address (at least some of) the aforementioned problems, and to provide the hereincited advantages and functions. A related object is to provide a moving pinch-roll mounted on a pivot arm, whose pivoting is resiliently resisted by flexible damping material.

The methods and means discussed herein, will generally be understood as constructed and operating as presently known in the art, except where otherwise specified; and with all materials, methods and devices and apparatus herein understood as implemented by known expedients according to present good practice.

DESCRIPTION OF FIGURES

FIG. 1A is a like view of a like arrangement showing flexure bias

FIG. 2 is a like view of a modified, less satisfactory arrangement showing a different bias-placement

PREFERRED EMBODIMENT

Figure 1:
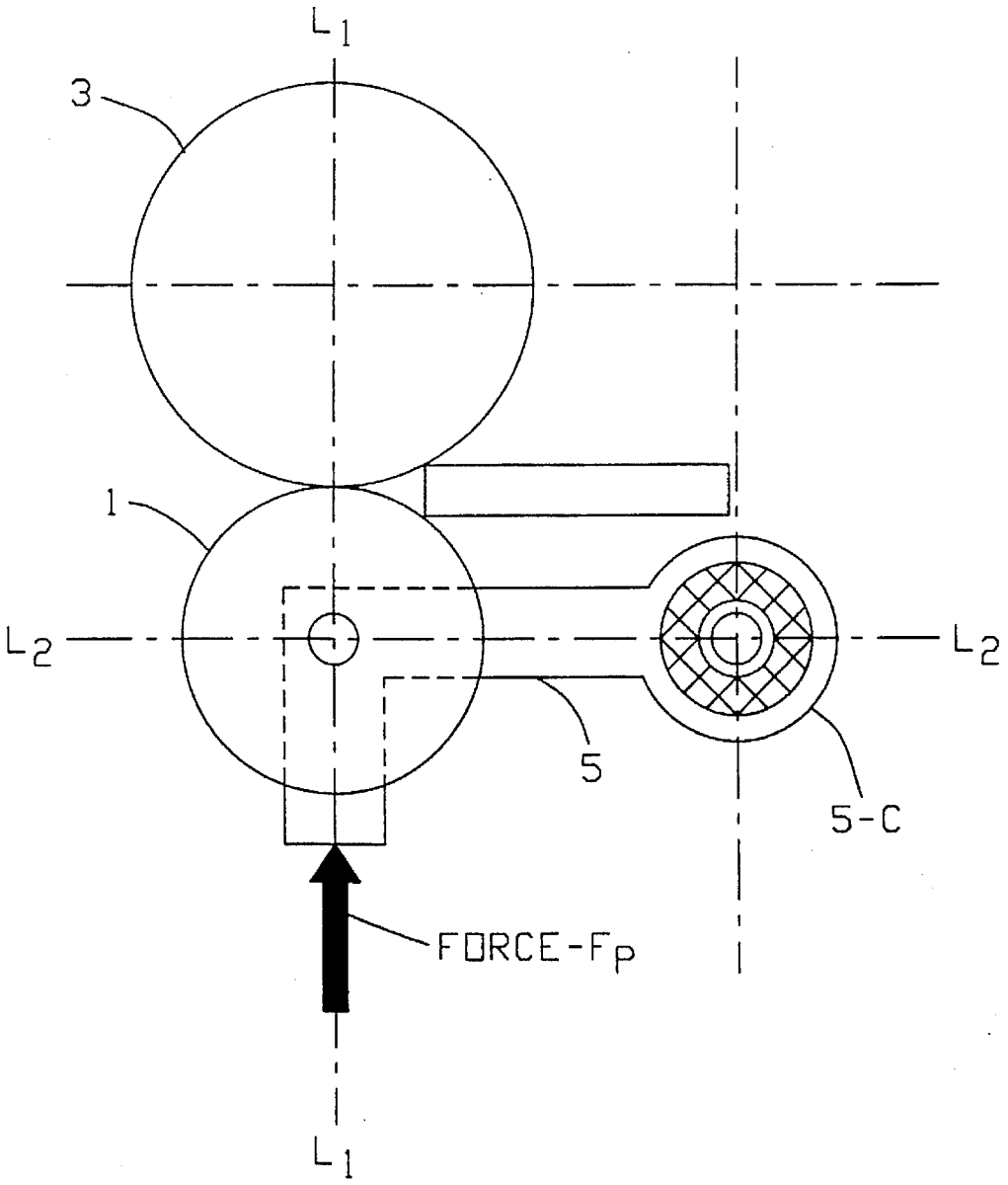
FIG. 1 is a very schematic sectional elevation of a preferred pinch roll embodiment.

FIG. 1 depicts a moveable pinch roll 1 opposed by a fixed drive roll 3 which may be assumed as rotated about its center by any number of known contemporary means. Normally, a document D is moved to the nip between this roll pair by known document feed means (eg. another upstream roll assembly, not shown—e.g. in a high-speed check-sorter). And the document will be withdrawn from this roll assembly 1, 3 to output means, such as another roll pair or to a stacker (neither shown, but well known in the art).

Moving Pinch roll 1, is cantilevered-out on an arm 5 which is free to pivot about a fixed end (eg. on a shaft 7, usually with sealed ball bearings to minimize friction and to prevent paper dust from accumulating in the bearing.

This fixed end of arm 5 comprises a flexible pivot assembly including a rigid hollow outer cylinder-end, 5-C enclosing a resilient damping cylinder (tube or sleeve 11) which, in turn, surrounds a rigid hollow inner cylinder 9 mounted to rotate on fixed shaft 7. Damping sleeve 11 comprises flexible damping material bonded to outer cylinder 5-C, and to inner cylinder 9. Before operation of the transport, the inner cylinder 9 will be understood as free to rotate around fixed shaft 7.

A pre-load force Fp is preferably applied, and preferably along a line $L_1$—$L_1$ through the "nip", i.e. through pinch roll centers and the contact point between the two rolls. Line $L_1$—$L_1$ is perpendicular to a line $L_2$—$L_2$ between the moving roll's center of rotation and the pivot point of arm 5 (fixed shaft 7). So applying the preload of arm 5 prevents static loads from developing on the flexible damping material 11, which could induce "creep" thereof and degrade bias Fp over time.

The pre-load force may be applied by any number of conventional means: coil spring, flexure, electric motor, magnets, hydraulic cylinder, etc., as known in the art.

Once preload force Fp is applied, the inner cylinder 9 is locked to fixed shaft 7, by any number of conventional means: set screw, clamp, bonding, welding, etc. When documents and/or protrusions thereon spread the roll 1, 3 apart, arm 5 will be allowed to rotate about fixed shaft 7, but only via flexible material 11. [must twist or shear tube 11].

If this flexible material 11 is also "high damping," (eg. as poly-urethane, certain rubber and other elastomers), any tendency of the pinch rolls to "spread apart", open the "nip" and lose contact with a document (i.e. to move normal to the document transport direction) will be limited by this damping, resulting in the document remaining in more continuous, intimate contact with rolls 1, 3.

Elastomer Tube (sleeve) 11 will thus preferably be torsionally-stressed when any over-thickness anomaly, such as a staple, enters the "nip" and will quickly urge the moveable roll 1 back toward the driving roll 3 once the anomaly passes the nip. Tube 11 should do this quickly, with constant force (no large return-force required) and without fatigue, degradation (e.g. overheating) or material failure, despite possible high-frequency service. Thus, Tube 11 should exhibit good torsional elasticity (e.g. over small, high-frequency excursions and minor loads—but no great radial elasticity required). Tube 11 should thus be "high-damping" to resist such high-frequency excursions and very quickly return the moveable roll 1 with little or no bounce—e.g. vs. a lo-damping material that might tend more to "creep", or bounce or otherwise allow the nip to remain "open" or enlarged by an abnormal thickness discontinuity, and so allow the rolls to lose contact with a passing document. Preferred materials for Tube 11, like poly-urethane will be recognized as suitable by workers (e.g. such as also used for flat drive-belts or the like). In certain instances, a part-tube (eg. 270° sector) may suffice.

Workers will appreciate the desireability of the prebias means, urging roll 1 vs. drive roll 3; and understand that, preferably, elastomer Tube 11 should not provide this, since such a relatively large, continuous static load could induce undesirable "creep" in the tube and so degrade the bias Fp over time. Thus, Tube 11 works better in conjunction with a separate pre-bias means as indicated in FIG. 1. A preferred example of such a pre-bias means is indicated by flexure f-b in FIG. 1A.

FIG. 1A will be understood as functionally equivalent to FIG. 1, while indicating use of a bias-flexure means f-b (eg. leaf spring as known in the art) to bear against a cooperating bias-detent projection 5-B of arm 5 adapted to direct bias force Fp along the nip-line $L_1$—$L_1$ between roll-centers as aforementioned.

Figure 3:
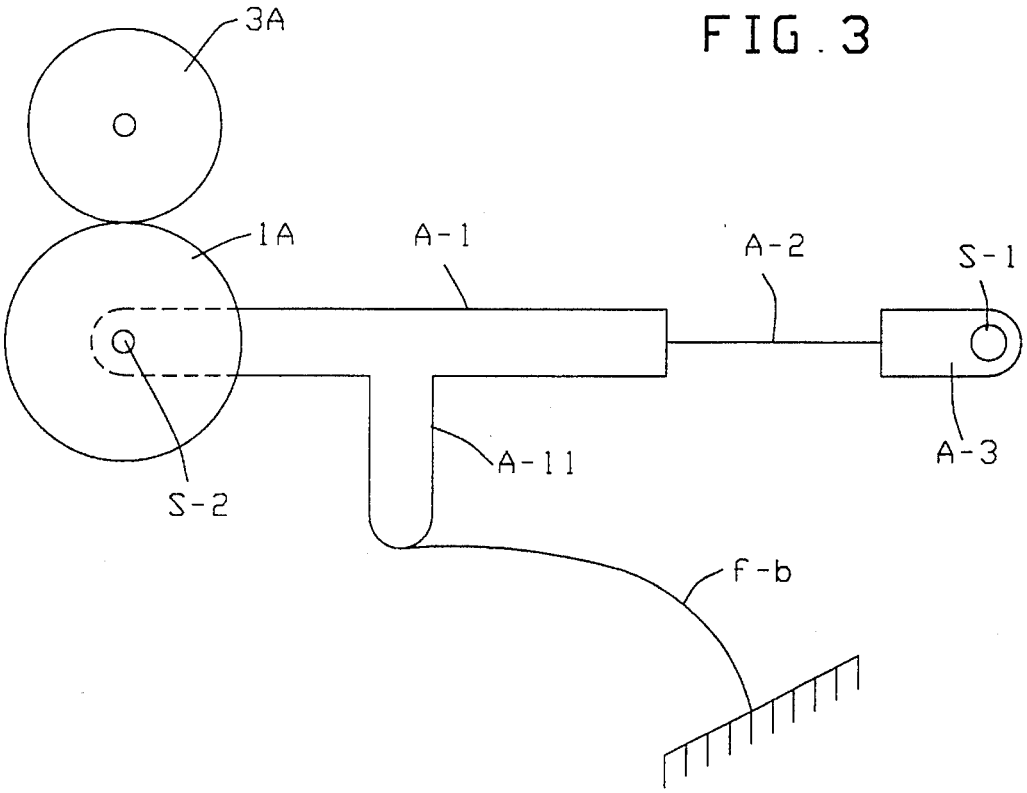
FIG. 3 is a like view of another modified less satisfactory arrangement showing a compound mounting-arm.
Figure 4:
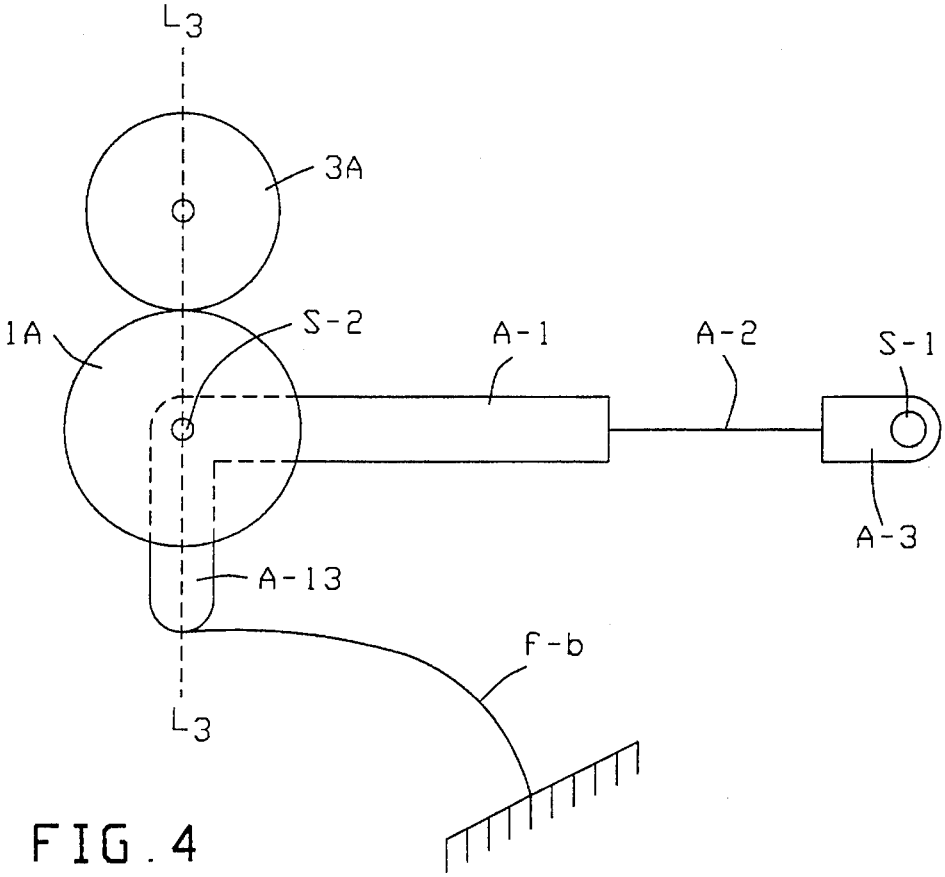
FIG. 4 is a like view of a satisfactory arrangement as in FIGS. 1, 1A, with bias applied along the roll-nip, and showing a compound mounting arm.

FIG. 4 shows a variation on FIG. 1A where a nip-bias flexure f-b is made to act along the nip-line $L_3$—$L_3$ (through the "nip", or rotation-center of rolls 1A, 3A—as with FIGS. 1, 1A); eg. so that a preload bias Fp can be applied, before locking pivot fixture A-3 on its shaft S-1, and thus without preloading the (damped) flexure arm-segment A-2. Here, as in FIG. 3, a compound (rigid/flexing) arm A-1, A-2 is used.

The foregoing (and other like) "roll-mount" embodiments will be seen as advantageously minimizing cost, assembly time etc., and will accommodate nip-anomalies, while quickly reacting and maximizing contact with the passing document.

Less satisfactory variations (FIGS. 2, 3):

FIG. 2 is a special, less-preferred case of FIG. 1A, where a like bias flexure f-b is applied to urge arm 5 and moving roll 1B vs. fixed drive roll 3B, except that flexure f-b is applied vs a bias-extension 5-b of arm 5 which is "offset" from the nip-line $L_1$—$L_1$ between roll centers.—this is less desirable. Also, a bushing (metal cylinder) bb is here bonded to elastomer cylinder 11 and mounted to rotate freely on fixed shaft 7-1 (eg. on bearings, if necessary). Thus, one may apply the flexure preload (with f-b) and then lock bushing bb in place, on shaft 7-1, to prevent its further rotation.

Also, damping means f-bb may optionally be applied to damp vibration, of arm 5; eg. via suitable damping flexure means f-bb, as workers will appreciate.

The FIG. 2 configuration (with detent 5-bb displaced from Line $L_1$—$L_1$ through the nip), is disfavored principally because it tends to put resilient Tube 11 in long-term static tension and thus may weaken it over time, or degrade $F_P$.

In FIG. 3, rolls 1A, 3A are opposed, with moveable roll 1A mounted to rotate on the distal end of a composite arm AA, comprising a rigid distal section A-1, coupled to a proximal resilient section (flexure leaf or the like) A-2, which is cantilevered-out from a rigid pivot fixture A-3, mounted to rotate on a fixed shaft S-1. Pivot fixture A-3 is preferably adapted to rotate loosely on 7-1 until locked thereon (eg. by known means, such as set-screw means—not shown, but well known in the art).—This may be done after arm AA is rotated so that moveable idler roll 1A contacts drive roll 3A. Preferably, resilient arm segment A-2 is also provided with damping means, as known in the art.

Moving idler roll 1A is mounted to rotate on its own fixed shaft S-2, mounted from arm segment A-1. (as known in the art; not illustrated in detail).

As in FIG. 2, offset pre-bias means is also provided to resiliently urge moveable roll 1A into contact with drive roll 3A (eg. via flexure leaf f-b, pushing arm-extension A-11, (provided as known in the art). Such a "compound" (rigid/flexible) mounting arm (A-1, A-2) may be less preferred in some instances (vs. a fully-rigid arm as in FIGS. 1, 1A).

Problem in FIGS. 2, 3:

The arrangements of FIGS. 2 and 3 would be satisfactory, in general, except that they apply an "offcenter-preload", i.e. other than along the "nip-line" (e.g. $L_1$—$L_1$ in FIG. 1) which undesirably places a static preload on the elastomer sleeve 11 of FIG. 2 or on the flexible element of FIG. 3. This will tend to cause "creep" problems, as workers can imagine—and so is best avoided—in favor of a preload which is "centered", i.e. along the "nip-line".

CONCLUSION

It will be understood that the preferred embodiments described herein are only exemplary, and that the invention is capable of many modifications and variations in construction, arrangement and use without departing from the spirit of the invention.

Since modifications of the invention are possible, for example the means and methods disclosed herein are also applicable to other pinch roll mounting arrangements, as well as to other related-and unrelated document-advance components; and it will be understood that the present invention is also applicable for enhancing other related sheet-advance arrangements (eg. document sorters, mail sorters, copiers, page feeders for printers, punch card transports, envelope stuffing machines, money feeders & transports in automatic teller machines.)

Examples given above of other possible variations of this invention are merely illustrative. Accordingly, the present invention is to be considered as including all possible modifications and variations within the scope of the invention as defined by and set forth in the appended claims.

What is claimed is:

1. A document feed array comprising pinch-roll means mounted to rotate about its center to engage prescribed documents, at a prescribed contact-site whereby to advance them, said roll means being mounted on relatively rigid cantilever-arm means pivoted at a pivot point distal from said center and including resilient means which, alone, couples said cantilever arm means to its pivot point in operation.

2. The array of claim 1 wherein a "preload" is also applied to said roll means directly along the radius intersecting said contact-site.

3. The array of claim 2 including driver means for rotating said roll means and/or advancing a document thereon.

4. The array of claim 3 wherein said driver means comprises a driver-roll means.

5. The array of claim 4 wherein said cantilever arm means is adapted to pivot about a prescribed pivot-shaft means, and includes bushing means mounted to be affixed on said shaft means, and wherein said resilient means is affixed about said bushing means.

6. The array of claim 5 wherein said cantilever arm means is rigid and also includes hollow cylinder means, surrounding said resilient means and affixed thereto.

7. The array of claim 6 wherein said pre-load is applied along the normal to the contact-site by flexure means preloading said arm to resiliently urge said roll means against said contact-site, along a related nip-line.

8. The array of claim 7 wherein said flexure means is also applied via an arm extension projected along said normal.

9. The array of claim 8 wherein said rigid cantilever arm is further damped against pivot-excursions by arm-damping means applied intermediate the arm-ends.

10. A method of advancing documents with pinch-roll means mounted to rotate about its center to engage prescribed documents, at a prescribed contact-site whereby to advance them, this method comprising:

mounting said pinch roll means on relatively rigid cantilever-arm means pivoted at a pivot point distal from said center; and providing flexible means so that it alone, couples said cantilever arm means to its pivot point in operation, while arranging said flexible means to accommodate thickness anomalies in said documents, yet maximize driving contact therewith.

11. The method of claim 10 wherein a "preload" is also applied to said roll means directly along the radius intersecting said contact-site.

12. The method of claim 11 including driver means for rotating said roll means and/or advancing a document thereon.

13. The method of claim 12 wherein said driver means comprises a driver-roll means.

14. The method of claim 13 wherein said cantilever arm means is adapted to pivot about a prescribed pivot-shaft means, and includes bushing means mounted to be affixed on said shaft means.

15. The method of claim 14 wherein said cantilever arm means is rigid and also includes hollow cylinder means, surrounding said flexible means and affixed thereto.

16. The method of claim 10 wherein a pre-load is applied along the contact-site by flexure means pre-loading said arm to resiliently urge said roll means against said contact-site, along a related nip-line.

17. The method of claim 16 wherein said flexure means is so applied via an arm extension projected along said nip-line.

18. The method of claim 17, wherein said rigid cantilever arm means is further damped against pivot-excursions by arm-damping means applied intermediate the arm-ends.

19. A document feed array comprising pinch-roll means mounted to rotate about its center to engage prescribed documents, at a prescribed contact-site whereby to advance them, said pinch roll means being mounted on cantilever-arm means pivoted at a pivot point at the arm means end distal from said center and including a rigid segment, and a relatively flexible segment and flexible means which, couples said arm means to its pivot point in operation, said flexible means being adapted to provide torsional resilience; a "preload bias" being applied to said pinch-roll means directly along the radius intersecting said contact-site; said array also including driver means including drive-roll means for rotating said roll means and/or advancing a document thereon; said cantilever arm means being adapted to pivot about a prescribed pivot-shaft means, and including bushing means mounted to be affixed on said shaft means.

20. A document feed array comprising a pair of pinch-rolls mounted to engage prescribed documents, at a prescribed intermediate contact-nip, whereby to advance them, one of said rolls being mounted on relatively rigid arm means pivoted at a pivot point distal from said contact nip and including flexible means which resiliently couples said arm means to said pivot point and is adapted to be torsionally, resiliently stressed by pivoting of said arm means.

21. The array of claim 20 wherein said arm means is adapted to pivot about a prescribed pivot-shaft means, and includes bushing means mounted to be affixed on said shaft means, and wherein said flexible means affixed about said bushing means.

22. A method of advancing documents with a pair of pinch-rolls mounted to engage the documents, at a prescribed intermediate contact-nip whereby to advance them, this method comprising:

mounting one of said rolls on relatively rigid arm means pivoted at a pivot point distal from said contact-nip; and providing flexible means so that it, alone, couples said arm means to said pivot point while arranging said flexible means to comprise high-damping, durable material adapted to be resiliently, torsionally stressed when said arm means is pivoted.

23. The method of claim 22 wherein said arm means is adapted to pivot about a prescribed pivot-shaft means, and includes bushing means mounted to be affixed on said shaft means, and wherein said flexible means is affixed about said bushing means.

24. The method of claim 23 wherein said arm means also includes hollow cylinder means surrounding said flexible means and affixed thereto.

25. A document feed array comprising pinch-roll means mounted to rotate about a prescribed roll-center point to engage prescribed documents, at a prescribed contact-site whereby to advance them, said pinch roll means being mounted on relatively rigid cantilever-arm means pivoted at a pivot point at the arm means end distal from said roll-center-point , and including a rigid segment and a relatively flexible segment, and also including flexible means which, alone, couples said arm means to its pivot point, said flexible means being adapted to provide torsional resilience; a "preload" bias being applied to said roll means directly along the radius intersecting said contact-site; said array also including drive-roll means for rotating said roll means and advancing a document thereon; said cantilever arm means being adapted to pivot about a prescribed pivot-shaft means.

* * * * *